US011254020B2

(12) United States Patent
Liu

(10) Patent No.: US 11,254,020 B2
(45) Date of Patent: Feb. 22, 2022

(54) SAFETY CUTTER

(71) Applicant: Tsang Wing Wong, Kowloon (HK)

(72) Inventor: Jiajie Liu, Kowloon (HK)

( * ) Notice: Subject to any disclaimer, the term of this patent is extended or adjusted under 35 U.S.C. 154(b) by 95 days.

(21) Appl. No.: 16/709,941

(22) Filed: Dec. 11, 2019

(65) Prior Publication Data

US 2021/0178616 A1 Jun. 17, 2021

(51) Int. Cl.
*B26B 1/08* (2006.01)
*B26B 1/10* (2006.01)

(52) U.S. Cl.
CPC . *B26B 1/08* (2013.01); *B26B 1/10* (2013.01)

(58) Field of Classification Search
CPC ..... B26B 1/08; B26B 5/001; B26B 5/003; B26B 5/005
USPC ..... 30/2, 162
See application file for complete search history.

(56) References Cited

U.S. PATENT DOCUMENTS 3,641,667 A * 2/1972 Leopoldi ..... B26B 5/005 30/2
4,683,656 A * 8/1987 Peyrot ..... B26B 5/003 30/162
4,713,885 A * 12/1987 Keklak ..... B26B 5/003 30/162
4,757,612 A * 7/1988 Peyrot ..... B26B 29/02 30/151
5,207,696 A * 5/1993 Matwijcow ..... A61B 17/3211 30/151
5,303,474 A * 4/1994 Keklak ..... B26B 5/003 30/162
5,426,855 A * 6/1995 Keklak ..... B26B 5/003 30/162
6,623,499 B1 * 9/2003 Andreini ..... A61B 17/3211 30/329
6,643,936 B2 * 11/2003 Carlson ..... B26B 25/005 30/162
6,813,833 B2 * 11/2004 Saunders ..... B26B 5/003 30/162
7,322,110 B2 * 1/2008 Hernandez ..... B26B 5/001 30/162
8,056,241 B2 * 11/2011 Davis ..... B26B 5/003 30/162
8,122,605 B2 * 2/2012 Votolato ..... B26B 5/003 30/2
8,220,160 B2 * 7/2012 Davis ..... B26B 3/06 30/162
8,250,764 B2 * 8/2012 Davis ..... B26B 5/003 30/162

(Continued)

*Primary Examiner* — Jason Daniel Prone

(57) ABSTRACT

The present invention relates to a safety cutter including a housing which receives a trigger, a transmission member, a pusher, a blade carrier and a blade. The transmission member is engaged operatively with the trigger via a gear assembly. The gear assembly allows the safety cutter to move the blade outward for a longer distance than conventional safety cutters. To prevent the gear assembly and the trigger rack portion from being displaced by tension generated during cutting, a first limiting member and a pair of second limiting members are provided in the housing. The blade carrier is releasably engaged with the transmission member to achieve automatic retraction of the blade into the housing after the blade leaves the cutting surface even if the trigger is not released.

8 Claims, 5 Drawing Sheets

(56) References Cited

U.S. PATENT DOCUMENTS 8,347,509 B2 * 1/2013 Votolato ..... B26B 5/00 30/151
8,353,109 B2 * 1/2013 Rohrbach ..... B26B 5/003 30/162
8,561,305 B2 * 10/2013 Davis ..... B26B 5/003 30/162
8,752,297 B2 * 6/2014 Rohrbach ..... B26B 5/003 30/158
8,776,380 B1 * 7/2014 Quimby ..... B26B 5/003 30/155
8,931,180 B2 * 1/2015 Davis ..... B26B 5/003 30/162
9,003,668 B2 * 4/2015 Landwehr ..... B26B 5/00 30/153
9,808,941 B2 * 11/2017 Jacobs ..... B26B 5/001
9,908,247 B2 * 3/2018 Herlitz ..... B26B 5/001
10,245,736 B2 * 4/2019 Huang ..... B26B 5/001
10,583,572 B2 * 3/2020 Herlitz ..... B26B 5/001
10,800,053 B1 * 10/2020 Liu ..... B26B 5/003
10,994,429 B2 * 5/2021 Wang ..... A61B 17/3211 30/151
10,994,434 B2 * 5/2021 Rohrbach ..... A61B 17/3211 30/329
11,084,178 B2 * 8/2021 Huang ..... B26B 5/001 30/162
11,097,434 B2 * 8/2021 Hooper ..... B26B 5/001 30/162
2002/0124418 A1 * 9/2002 Votolato ..... B26B 5/001 30/294
2004/0237312 A1 * 12/2004 Hernandez ..... B26B 5/003 30/162
2008/0163493 A1 * 7/2008 Votolato ..... B26B 5/003 30/154
2008/0282547 A1 * 11/2008 Leger ..... B26B 1/08 30/162
2010/0223793 A1 * 9/2010 Hansen ..... B26B 5/001 30/162
2011/0041345 A1 * 2/2011 Austin ..... B26B 5/001 30/162
2011/0302787 A1 * 12/2011 Rohrbach ..... B26B 5/001 30/162
2013/0239415 A1 * 9/2013 Wagner ..... B26B 1/08 30/162
2016/0167239 A1 * 6/2016 Gallegos ..... B26B 5/001 30/162
2016/0279811 A1 * 9/2016 Huang ..... B26B 1/08
2016/0325442 A1 * 11/2016 Herlitz ..... B26B 1/10
2020/0023528 A1 * 1/2020 Rohrbach ..... B26B 5/001
2020/0338767 A1 * 10/2020 Rohrbach ..... B26B 5/003

* cited by examiner

SAFETY CUTTER

BACKGROUND OF THE INVENTION

The present invention relates to a safety cutter and more particularly pertains to a safety cutter with automatically retracts the blade into the housing after the blade leaves the cutting surface even if the trigger is not released.

A convention safety cutter usually comprises a housing which receives a trigger, a transmission member, a blade carrier and a blade. When the user pushes the trigger, the transmission member is driven to move the blade carrier forward, thus exposing the blade out of the housing to preform cutting operation. After the cutting operation is complete, a user is required to release the trigger to retract the blade into the housing. However, sometimes a user may inadvertently forget to release the trigger after the cutting operation, and the exposed blade may injure the user or other people near the user.

Besides, in conventional safety cutters, it is difficult to push the blade outward for a long distance. This is because in the trigger mechanism in conventional safety cutters, when a user presses the trigger for a certain distance (e.g. 1 mm), the trigger could only drive the blade to move outward for the same distance (e.g. 1 mm). Due to limitation in the space provided to accommodate the trigger mechanism in safety cutters, it is usually impossible for the blade to be pushed outward for a long distance. This would pose difficulties for users when it is necessary to cut through thicker materials.

BRIEF SUMMARY OF THE INVENTION

In view of the aforesaid disadvantages now present in the prior art, an object of the present invention is to provide a safety cutter which is capable of moving the blade outward for a longer distance than conventional safety cutters.

It is a further object of the present invention to provide a safety cutter wherein the blade carrier is releasably engaged with the transmission member to achieve automatic retraction of the blade into housing after the blade leaves the cutting surface even if the trigger is not released, thus improving safety of the cutter.

To attain these, the present invention comprises a housing which receives a trigger, a transmission member, a blade carrier and a blade. The housing has a front end with a blade opening for a blade to protrude outwards therefrom and a rear end opposite to the front end. The trigger is movable between an actuated positon and a rest position. The transmission member is engaged operatively with the trigger via a gear assembly to move between a biased transmission member retracted position when the trigger is at the rest position and a transmission member extended position when the trigger is at the actuated position. The blade carrier is transversely fixed in the housing for carrying the blade, and is releasably engaged with the transmission member and longitudinally movable between a biased blade carrier retracted position where the blade is entirely received within the housing and a blade carrier extended position where the blade is at least partially exposed out of the housing via the blade opening for performing cutting operation. The trigger comprises a handle portion exposed outside the housing and a trigger rack portion which extends from the handle portion into the housing in a direction which is substantially perpendicular to which the blade is moved. The transmission member comprises a transmission rack portion which extends longitudinally in a direction substantially parallel to which the blade is moved. The gear assembly comprises a first gear engaged operatively with the trigger rack portion, a second gear coaxially and rotationally engaged with the first gear via a gear rotations shaft and engaged operatively with the transmission rack portion. The first gear has a smaller number of teeth than the second gear. A first limiting member provided in the housing is configured to abut against a top portion of a rear wall of the trigger rack portion for preventing rearward movement of the trigger. A pair of second limiting members provided in the housing is positioned on two substantially opposite sides of the second gear for preventing longitudinal movement of the second gear.

The safety cutter further comprises a pusher received in the housing at a front end of the transmission member having a first inclined surface and a second inclined surface. At the blade carrier extended position, the blade carrier is pivotally rotatable between an unlifted position when no external force is exerted upon the blade and a lifted position when the blade is pressed upon a cutting surface to perform cutting operation. A first protrusion is provided on the blade carrier and cooperates with the first inclined surface for facilitating disengagement of the transmission member from the blade carrier when the blade carrier is pivotally rotated from the unlifted position to the lifted position. A second protrusion is provided on the blade carrier and cooperates with the second inclined surface for facilitating engagement of the transmission member with the blade carrier when the blade carrier is at the blade carrier retracted positon and the transmission member returns from the transmission member extended position to the transmission member retracted position as the trigger returns from the actuated position to the rest position.

The safety cutter further comprises a third protrusion extended upwards from the blade carrier which engages with a downward-facing recess at a top inner portion of the housing when the blade carrier is at the lifted position to prevent the blade carrier from returning to the blade carrier retracted position.

The recess has an inclined rear wall which extends from a rear bottom end of the recess upwards and forwards towards a rear top end of the recess for facilitating disengagement of the third protrusion from the recess when the blade carrier is returned from the lifted position to the unlifted position.

The blade carrier further comprises a first pin extending from a first side thereof which is inserted into and slides in a first guiding groove formed on a first inner wall of the housing, and a second pin extending from a second side thereof which is inserted into and slides in a second guiding groove formed on a second inner wall of the housing; the second guiding groove has a horizontal portion and an upward sloping portion for the second pin to slide therein when the blade carrier rotates upwards from the unlifted position to the lifted position.

The blade carrier further comprises a blade carrier spring with one end thereof coupled to the blade carrier and another end thereof coupled to the housing for biasing the blade carrier towards the blade carrier retracted position.

The transmission member further comprises a transmission spring with one end thereof coupled to the transmission member and another end thereof coupled to the housing for biasing the transmission member towards the transmission member retracted position.

The first protrusion is a cuboid which extends along a direction substantially parallel to which the blade is moved; the second protrusion is a cuboid which extends along a direction substantially perpendicular to which the blade is moved and forms an L-shape with the first protrusion.

The pusher comprises a lower pusher portion and an upper pusher portion extending upwards and inwards therefrom; the lower pusher portion is a cuboid with its top side coplanar with and substantially flushes against a top side of the first protrusion when the blade carrier is engaged with the transmission member and the blade carrier is at the unlifted position; the upper pusher portion has a rear side coplanar with and substantially flushes against a front side of the second protrusion when the blade carrier is at the blade carrier retracted position and the rear side reaches the second protrusion while the trigger returns from the actuated position to the rest position, a front side parallel to the rear side with its inner end extending inwards so that the front side is partially abutted against a rear side of the second protrusion when the blade carrier is engaged with the transmission member and the blade carrier is at the unlifted position, an inner side joining an inner edge of the rear side and an inner edge of the front side to form the first inclined surface, a bottom side with an outer portion which aligns with the top side of the lower pusher portion and a triangular-shaped inner portion which extends upwards and inwards from the outer portion to join a bottom edge of the inner side to form the second inclined surface.

DETAILED DESCRIPTION OF THE INVENTION

Figure 1:
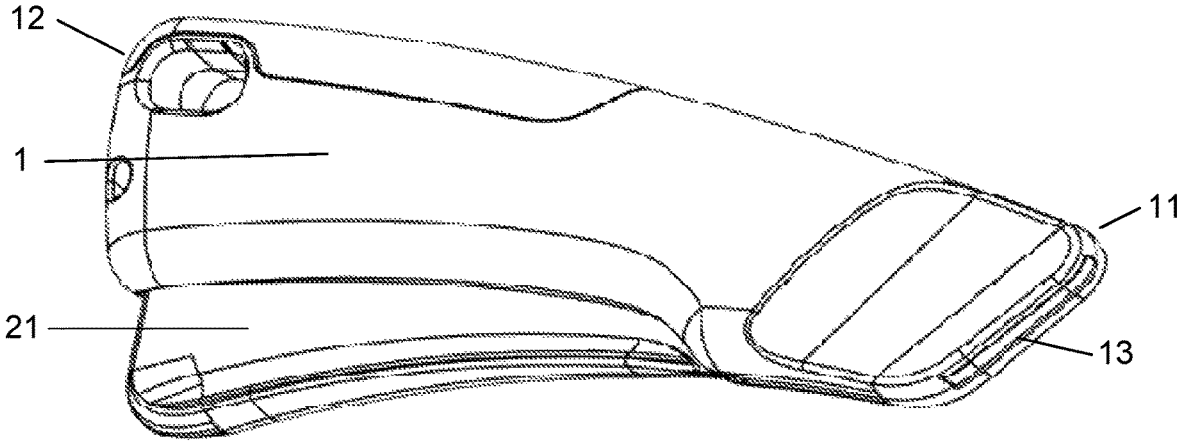
FIG. 1 is a perspective view of a preferred embodiment of the present invention.
Figure 2:
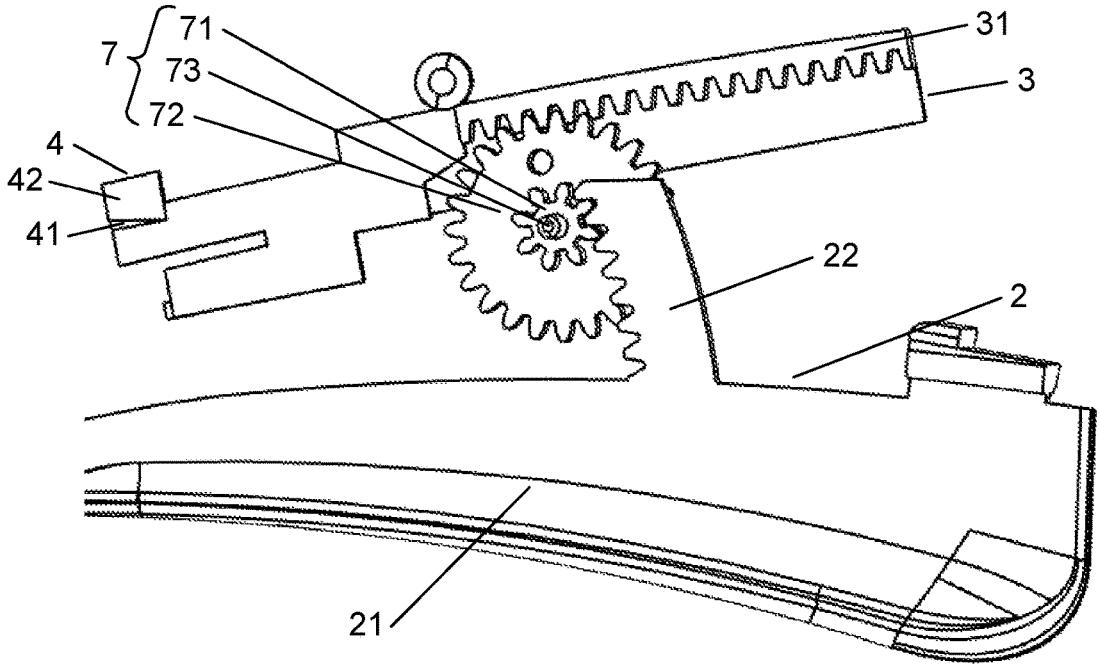
FIG. 2 is a partial perspective view illustrating the interconnection among the trigger, the gear assembly and the transmission member of the preferred embodiment.
Figure 3:
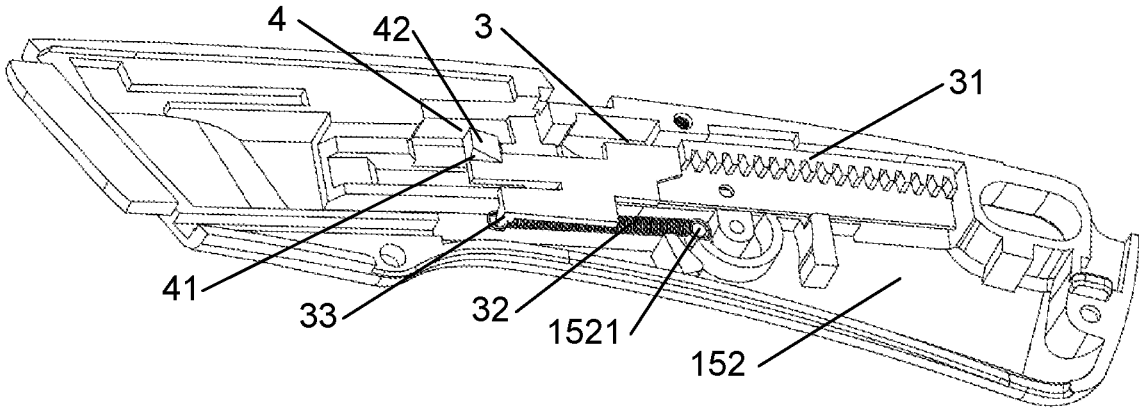
FIG. 3 is a partial perspective view illustrating the position of the transmission spring of the preferred embodiment.
Figure 4:
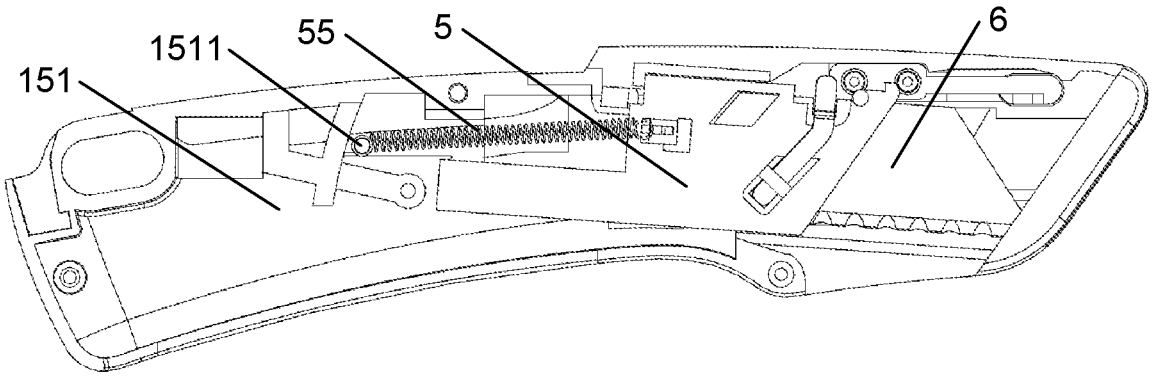
FIG. 4 is a partial perspective view illustrating the position of the blade carrier spring of the preferred embodiment.
Figure 5:
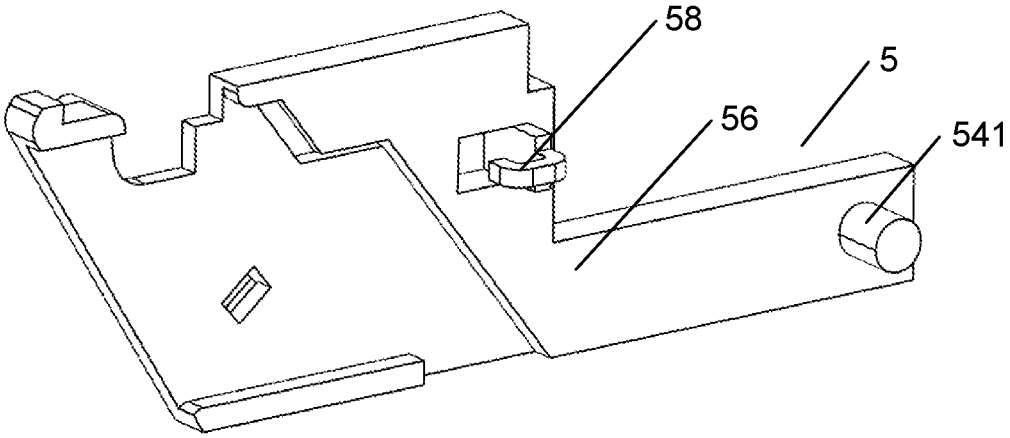
FIG. 5 is a perspective view of the blade carrier of the preferred embodiment.
Figure 6:
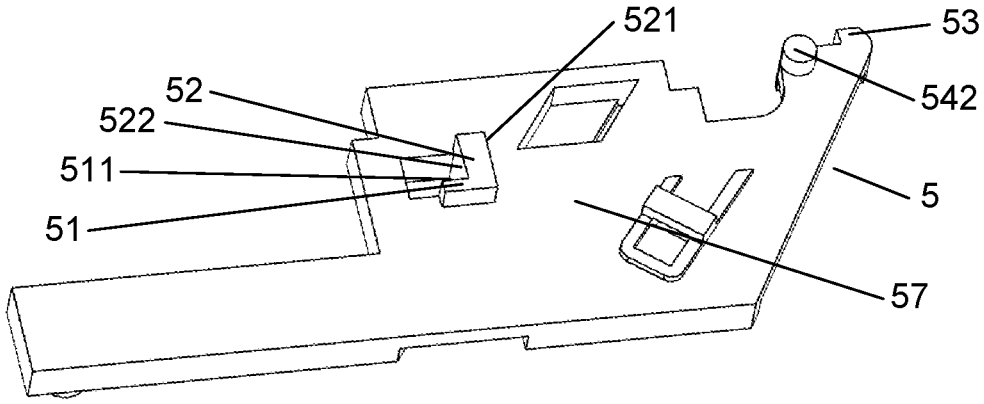
FIG. 6 is another perspective view of the blade carrier of the preferred embodiment.
Figure 7:
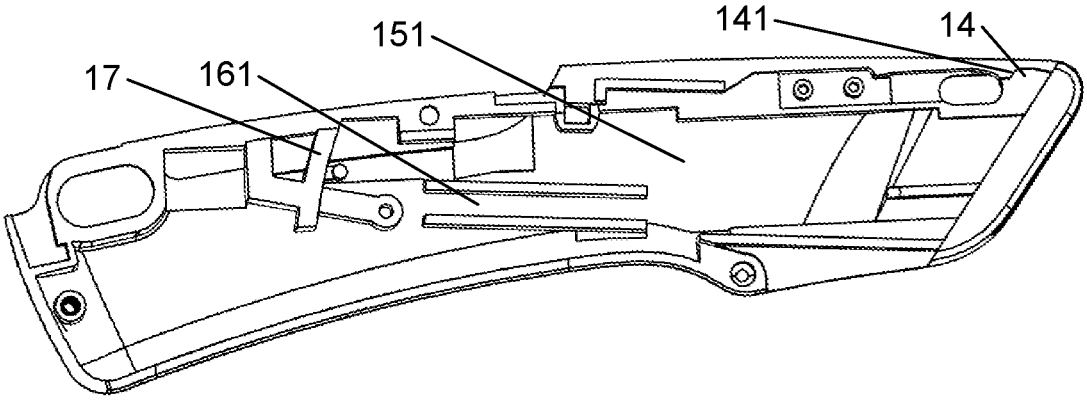
FIG. 7 is a perspective view illustrating the first guiding groove formed on the first inner wall of the housing of the preferred embodiment.
Figure 8:
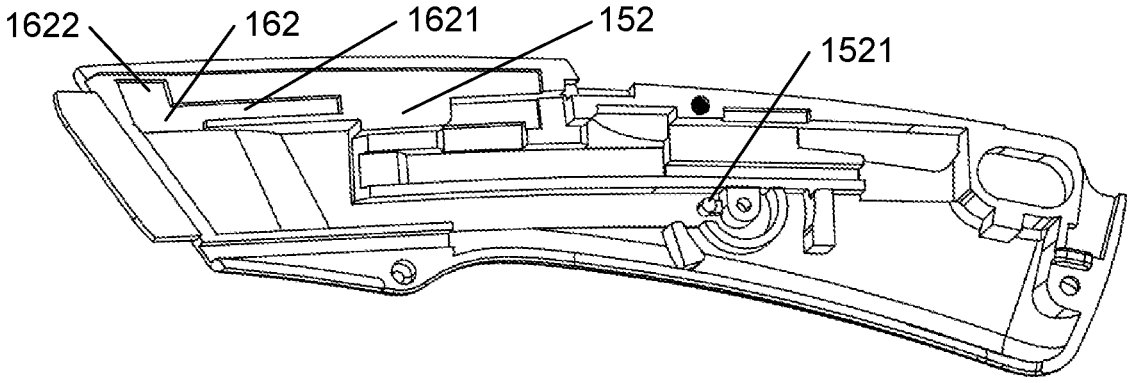
FIG. 8 is a perspective view showing the second guiding groove formed on the second inner wall of the housing of the preferred embodiment.
Figure 9:
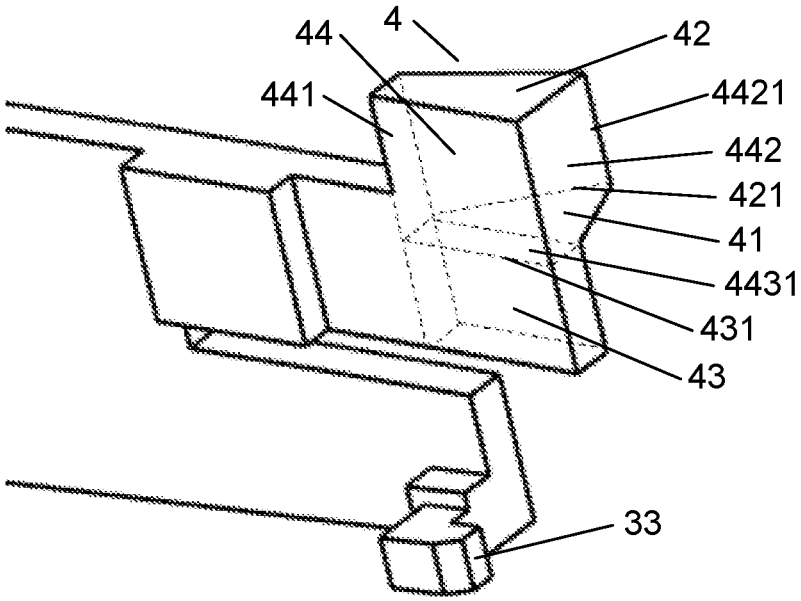
FIG. 9 is a schematic view illustrating the pusher of the preferred embodiment.

As illustrated in FIGS. 1-13, the safety cutter of the present embodiment comprises a housing 1 which receives a trigger 2, a transmission member 3, a pusher 4, a blade carrier 5, and a blade 6.

When the safety cutter of the present invention is in an upright position (see FIG. 1), the housing 1 has a front end 11 and a rear end 12 opposite to the front end 11. The front end 11 has a blade opening 13 for the blade 6 to protrude outwards from the housing 1.

The trigger 2 is movable between an actuated positon and a rest position. It comprises a handle portion 21 exposed outside the housing 1 and a trigger rack portion 22 which extends from the handle portion 21 into the housing 1 in a direction which is substantially perpendicular to which the blade 6 is moved.

The transmission member 3 is engaged operatively with the trigger 2 via a gear assembly 7 to move between a biased transmission member retracted position when the trigger 2 is at the rest position and a transmission member extended position when the trigger 2 is at the actuated position. It comprises a transmission rack portion 31 which extends longitudinally in a direction parallel to which the blade 6 is moved. The gear assembly 7 comprises a first gear 71 engaged operatively with the trigger rack portion 22, a second gear 72 coaxially and rotationally engaged with the first gear 71 via a gear rotation shaft 73. The second gear 72 is engaged operatively with the transmission rack portion 31. The first gear 71 has a smaller number of teeth than the second gear 72. In this embodiment, the number of teeth of the first gear 71 is 8, and the number of teeth of the second gear 72 is 24. With the gear ratio between the first gear 71 and the second gear 72 in the present invention, movement of the trigger 2 for a first distance could drive the movement of the transmission member 3 (together with the blade carrier 5 and the blade 6) for a longer distance than the first distance, thereby not only saving user effort in pushing the blade 6 out of the housing 1 for cutting, but also allows the blade 6 to be pushed outward from the housing 1 for a longer distance than convention safety cutter. A transmission spring 32 with one end coupled to a hook 33 of the transmission member 3 and another end coupled to a protrusion 1521 of the second inner wall 152 of the housing 1 is provided to bias the transmission member 3 towards the transmission member retracted position.

The pusher 4 is provided at a front end of the transmission member 3 and has a first inclined surface 41 and a second inclined surface 42.

The blade carrier 5, which is adapted to carry the blade 6 in known manner, is transversely fixed in the housing 1 and moves longitudinally along the housing 1 guided by a first guiding groove 161 formed on a first inner wall 151 of the housing 1 and a second guiding groove 162 formed on a second inner wall 152, which is opposite to the first inner wall 151, of the housing 1. The first guiding groove 161 is horizontal in shape. The second guiding groove 162 comprises a horizontal portion 1621 and an upward sloping portion 1622. The blade carrier 5 has a first pin 541 which extends from a first side 56 of the blade carrier 5 and inserts into and slides in the first guiding groove 161, and a second pin 542 which extends from a second side 57 of the blade carrier 5, which is opposite to the first side 56, and inserts into and slides in the second guiding groove 162. The first guiding groove 161 and the second guiding groove 162 act on the first pin 541 and the second pin 542 to prevent transverse movement of the blade carrier 5. The blade carrier 5 is releasably engaged with the transmission member 3 and movable between a biased blade carrier retracted position where the blade 6 is entirely received within the housing 1 and a blade carrier extended position where the blade 6 is at least partially exposed out of the housing 1 via the blade opening 13 for performing cutting operation. A blade carrier spring 55 with one end coupled to a hook 58 of the blade carrier 5 and another end coupled to a protrusion 1511 on the first inner wall 151 of the housing 1 is provided to bias the blade carrier 5 towards the blade carrier retracted position. At the blade carrier extended position, when the blade 6 is pressed upon a cutting surface to perform cutting operation, external force is exerted upon the blade 6, thereby driving the first pin 541 to rotate in the first guiding groove 161 and the second pin 542 to slide upwards along the upward sloping portion 1622 of the second guiding groove 162, and thus driving the blade carrier 5 to pivotally rotate upwards from the unlifted position to the lifted positon.

The blade carrier 5 further comprises a first protrusion 51, a second protrusion 52 and a third protrusion 53. The first protrusion 51 operates with the first inclined surface 41 for facilitating disengagement of the transmission member 3 from the blade carrier 5 when the blade carrier 5 is pivotally rotated from the unlifted position to the lifted position. The second protrusion 52 cooperates with the second inclined surface 42 for facilitating engagement of the transmission member 3 with the blade carrier 5 when the blade carrier 5 is at the blade carrier retracted positon and the transmission member 3 returns from the transmission member extended position to the transmission member retracted position as the trigger 2 is released to return from the actuated position to the rest position.

Figure 10:
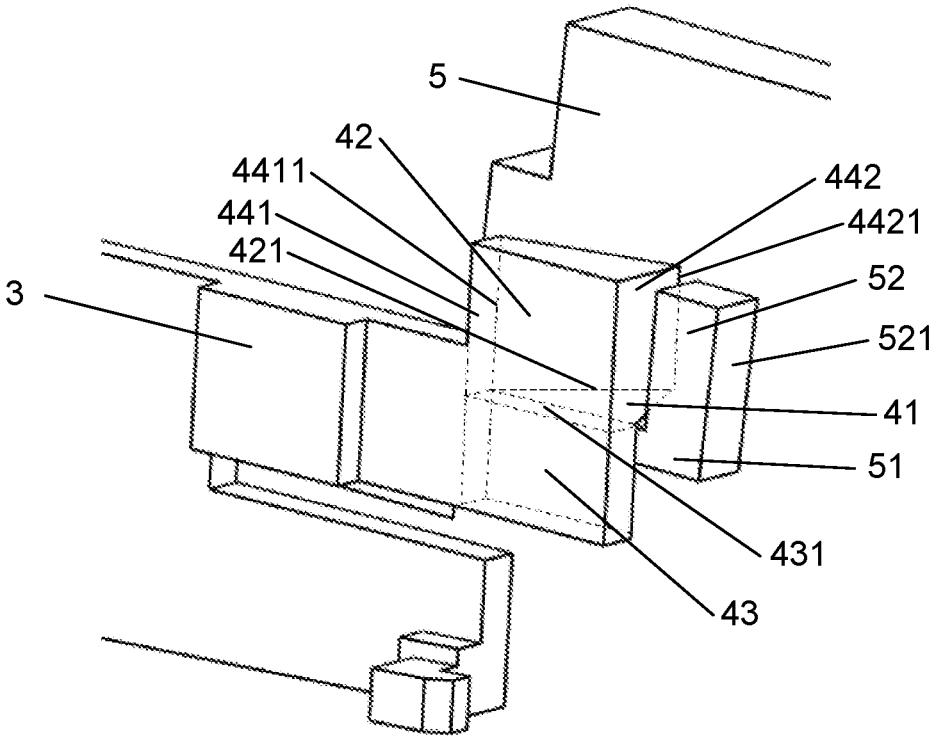
FIG. 10 is a schematic view illustrating the pusher, the first protrusion and the second protrusion when the transmission member is engaged with the blade carrier.
Figure 11:
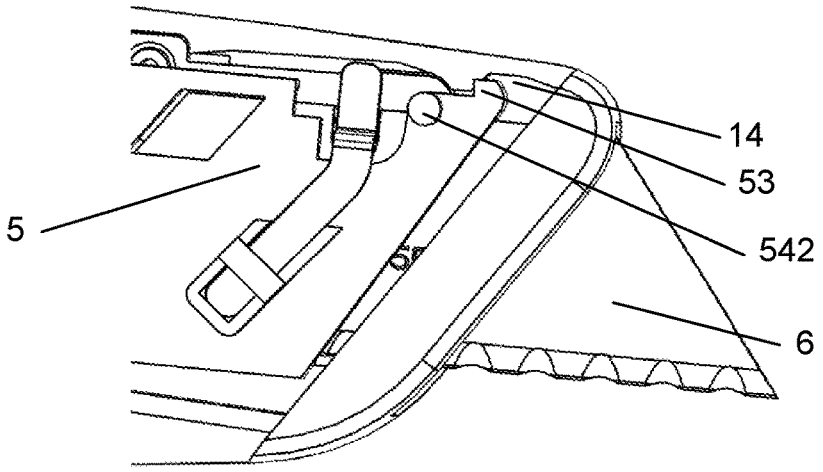
FIG. 11 is a schematic view illustrating the blade carrier when the blade carrier moves upwards from the unlifted position to the lifted position.
Figure 12:
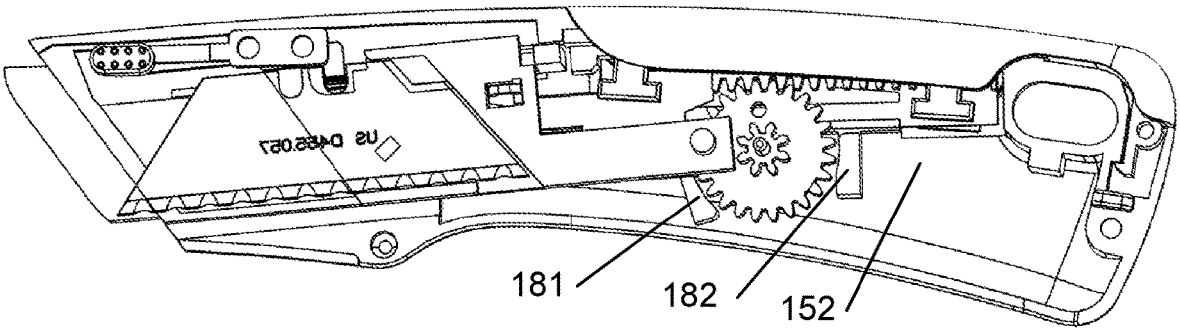
FIG. 12 is a schematic view illustrating the pair of second limiting members on the second inner wall.
Figure 13:
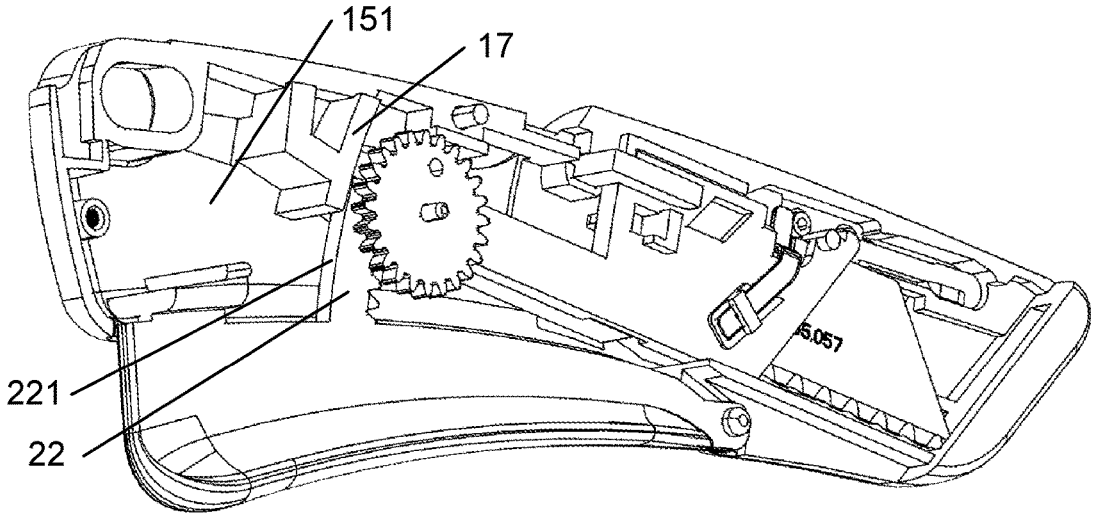
FIG. 13 is a schematic view illustrating the first limiting member on the first inner wall and the trigger.

In this embodiment, the first protrusion 51 is a cuboid which extends along a direction substantially parallel to which the blade 6 is moved; the second protrusion 52 is a cuboid which extends along a direction substantially perpendicular to which the blade 6 is moved and forms an L-shape with the first protrusion 5*t* The pusher 4 comprises a lower pusher portion 43 and an upper pusher portion 44 extending upwards and inwards therefrom. The lower pusher portion 43 is a cuboid with its top side 431 coplanar with and substantially flushes against a top side 511 of the first protrusion 51 when the blade carrier 5 is engaged with the transmission member 3 and the blade carrier 5 is at the unfitted position, as shown in FIG. 10. The front side 442 of the upper pusher portion 44 is parallel to the rear side 441 with its inner end 4421 extending inwards so that the front side 442 partially abuts against a rear side 522 of the second protrusion 52 when the blade carrier 5 is engaged with the transmission member 3. The second inclined surface 42 is formed by an inner side of the upper pusher portion 44 which joins the inner edge 4411 of the rear side 441 and the inner edge 4421 of the front side 442. The bottom side of the upper pusher portion 44 has an outer portion 4431 which aligns with the top side 431 of the lower pusher portion 43 and a triangular-shaped inner portion forming the first inclined surface 41. The first inclined surface 41 extends upwards and inwards from the outer portion 4431 to join the bottom edge 421 of the second inclined surface 42.

The third protrusion 53 extends upwards from the blade carrier 5 and engages with a downward-facing recess 14 at a top inner portion of the housing 1 when the blade carrier 5 is at the lifted position to prevent the blade carrier 5 from returning to the blade carrier retracted position. The recess 14 has an inclined rear wall 141 which extends from a rear bottom end of the recess 14 upwards and forwards towards a rear top end of the recess 14. The inclined rear wall 141 facilitates disengagement of the third protrusion 53 from the recess 14 when the blade carrier 5 is returned from the lifted position to the unlifted position.

The operation of the present embodiment is as follows:

Initially, the trigger 2 is at the rest position, the transmission member 3 is at the transmission member retracted position, the blade carrier 5 is at the blade carrier retracted position, the blade carrier 5 is engaged with the transmission member 3, and the blade 6 is entirely received within the housing 1.

To perform cutting operation, the trigger handle 21 is pressed upwards to move the trigger 2 from the rest position to the actuated position; the trigger rack portion 22 is thereby pushed upwards to drive the first gear 71 to rotate in a first direction. The second gear 72 is driven by rotation of the first gear 71 to rotate in the first direction, and thereby driving the transmission rack portion 31 to overcome the biasing force of the transmission spring 32 to move laterally towards the front end 11 of the housing 1, thereby moving the transmission member 3 from the transmission member retracted position to the transmission member extended position. The blade carrier 5, which is being engaged with the transmission member 3, is driven by the transmission member 3 to overcome the biasing force of the blade carrier spring 55 to move laterally towards the front end 11 of the housing 1, thereby moving from the blade carrier retracted position to the blade carrier extended position where the blade 6 is at least partially exposed out of the housing 1 via the blade opening 13 for performing cutting operation. At this time, the blade carrier is at the unlifted position.

When the blade 6 is pressed upon a cutting surface to perform cutting, the blade 6 is pushed upwards, thus driving the first pin 541 to rotate in the first guiding groove 161 and the second pin 542 to slide upwards along the upward sloping portion 1622 of the second guiding groove 162, and thus driving the blade carrier 5 to rotate upwards from the unlifted position to the lifted position, and the third protrusion 53 is thereby moved upwards into the recess 14. The upward movement of the blade carrier 5 causes the first protrusion 51 to move upwards along and relative to the first inclined surface 41; as the blade carrier 5 is transversely fixed and restricted from moving sideways, the pusher 4 is pushed outwards away from the blade carrier 5, thereby disengaging the transmission member 3 from the blade carrier 5 when the first protrusion 51 slides past the first inclined surface 41. At this time, as long as the blade 6 is pressed upon a cutting surface, the third protrusion 53 would continue to engage with the recess 14, and thus the blade carrier 5 is prevented from moving backwards towards the blade carrier retracted position during cutting.

When the blade 6 leaves the cutting surface, the blade carrier 5 which is being disengaged from the transmission member 3 is biased by the blade carrier spring 55 to return to the blade carrier retracted position, thereby also pulling the third protrusion 53 to slide backwards and downwards along the inclined rear wall 141 of the recess 14 to return the blade carrier 5 from the lifted position to the unlifted position. The blade 6 is drawn into the housing 1 automatically when the blade 6 leaves the cutting surface, even when the trigger 2 is still at the actuated position. As a result, safety of the cutter could be improved as user is prevented from injured by the exposed blade 6 when the user misses to release the trigger 2 after cutting.

When the trigger 2 is released, the transmission member 3 is biased by the transmission spring 32 to return to the transmission member retracted position. The lateral movement of the transmission member 3 towards the rear end 12 of the housing 1 drives rotation of the second gear 72 and the first gear 71 in a second direction opposite to the first direction, thus pushing the trigger rack portion 22 downwards and the handle portion 21 then returns to the original position. As the transmission member 3 returns to the transmission member retracted position, when the rear side 441 of the upper pusher portion 44 reaches the second protrusion 52, the rear side 441 is coplanar with and substantially flushes against the front side 521 of the second protrusion 52; as the transmission member 3 continues to move backwards, and as the blade carrier 5 is transversely fixed and restricted from moving sideways, the second inclined surface 42 continues to slide past the second protrusion 52, until at the time when the transmission member 3 reaches the transmission member retracted position, the transmission member 3, being an elongated body made of an elastic material, returns to its initial position with the front side 442 of the upper pusher portion 44 partially abuts against the rear side 522 of the second protrusion 52, thereby engaging the transmission member 3 with the blade carrier 5.

During cutting operation when the trigger 2 is pressed or the blade 6 is pressed upon a cutting surface, tension is applied to the gear assembly 7 and also the trigger rack portion 22. In order to prevent the gear assembly 7 and the trigger rack portion 22 from being displaced by such tension, a first limiting member 17 is provided in the housing 1 to abut against a top portion of a rear wall 221 of the trigger rack portion 22 for preventing rearward movement of the trigger 2. In this embodiment, the first limiting member 17 is in form of an arc-shaped protrusion provided on the first inner wall 151 of the housing 1. The arc-shaped protrusion being the first limiting member 17 supports the entire width of the top portion of the rear wall 221 of the trigger rack portion 22. Besides, a pair of second limiting members 181, 182 is provided on the second inner wall 152 of the housing 1 on two substantially opposite sides of the second gear 72 for preventing longitudinal movement of the second gear 72. In this way, the safety cutter of the present invention is more durable.

The above embodiment is a preferred embodiment of the present invention. The present invention is capable of other embodiments and is not limited by the above embodiment. Any other variation, decoration, substitution, combination or simplification, whether in substance or in principle, not deviated from the spirit of the present invention, is replacement or substitution of equivalent effect and falls within the scope of protection of the present invention.

What is claimed is:

1. A safety cutter comprising, when in an upright position, a blade;

a housing having a front end with a blade opening for the blade to protrude outwards therefrom and a rear end opposite to the front end;

a trigger received in and movably attached to the housing so as to be movable between an actuated positon and a rest position;

a transmission member received in the housing and engaged operatively with the trigger via a gear assembly to move between a biased transmission member retracted position when the trigger is at the rest position and a transmission member extended position when the trigger is at the actuated position;

a blade carrier transversely fixed in the housing for carrying the blade, and is releasably engaged with the transmission member and longitudinally movable between a blade carrier retracted position where the blade is entirely received within the housing and a blade carrier extended position where the blade is at least partially exposed out of the housing via the blade opening for performing cutting operation when the trigger is at the actuated position;

the trigger comprises a handle portion exposed outside the housing and a trigger rack portion which extends from the handle portion into the housing in a direction which is substantially perpendicular to which the blade is moved; the transmission member comprises a transmission rack portion which extends longitudinally in a direction substantially parallel to which the blade is moved; the gear assembly comprises a first gear engaged operatively with the trigger rack portion, a second gear coaxially and rotationally engaged with the first gear via a gear rotations shaft and engaged operatively with the transmission rack portion; the first gear has a smaller number of teeth than the second gear;

a first limiting member provided in the housing is configured to abut against a top portion of a rear wall of the trigger rack portion for preventing rearward movement of the trigger;

a pair of second limiting members provided in the housing is positioned on two substantially opposite sides of the second gear for preventing longitudinal movement of the second gear.

2. The safety cutter as in claim 1, wherein the blade carrier further comprises a blade carrier spring with one end thereof coupled to the blade carrier and another end thereof coupled to the housing for biasing the blade carrier towards the blade carrier retracted position.

3. The safety cutter as in claim 1, wherein the transmission member further comprises a transmission spring with one end thereof coupled to the transmission member and another end thereof coupled to the housing for biasing the transmission member towards the transmission member retracted position.

4. The safety cutter as in claim 1, wherein it further comprises a pusher received in the housing on a front end of the transmission member having a first inclined surface and a second inclined surface; at the blade carrier extended position, the blade carrier is pivotally rotatable between an unlifted position when no external force is exerted upon the blade and a lifted position when the blade is pressed upon a cutting surface to perform cutting operation;

a first protrusion provided on the blade carrier which cooperates with the first inclined surface for facilitating disengagement of the transmission member from the blade carrier when the blade carrier is pivotally rotated from the unlifted position to the lifted position; and a second protrusion provided on the blade carrier which cooperates with the second inclined surface for facilitating engagement of the transmission member with the blade carrier when the blade carrier is at the blade carrier retracted positon and the transmission member returns from the transmission member extended position to the transmission member retracted position as the trigger returns from the actuated position to the rest position.

5. The safety cutter as in claim 4, wherein it further comprises a third protrusion provided on the blade carrier and extended upwards from the blade carrier which engages with a downward-facing recess at a top inner portion of the housing when the blade carrier is at the lifted position to prevent the blade carrier from returning to the blade carrier retracted position.

6. The safety cutter as in claim 5, wherein the recess has an inclined rear wall which extends from a rear bottom end of the recess upwards and forwards towards a rear top end of the recess for facilitating disengagement of the third protrusion from the recess when the blade carrier is returned from the lifted position to the unlifted position.

7. The safety cutter as in claim 4, wherein the blade carrier further comprises a first pin extending from a first side thereof which is inserted into and slides in a first guiding groove formed on a first inner wall of the housing, and a second pin extending from a second side thereof which is inserted into and slides in a second guiding groove formed on a second inner wall of the housing; the second guiding groove has a horizontal portion and an upward sloping portion for the second pin to slide therein when the blade carrier rotates upwards from the unlifted position to the lifted position; the first limiting member is provided on the first inner wall; the second limiting members are provided on the second inner wall.

8. The safety cutter as in claim 4, wherein the first protrusion is a cuboid which extends along a direction substantially parallel to which the blade is moved; the second protrusion is a cuboid which extends along a direction substantially perpendicular to which the blade is moved and forms an L-shape with the first protrusion.

* * * * *